US006134994A

United States Patent [19]

Gomas

[11] Patent Number: 6,134,994

[45] Date of Patent: Oct. 24, 2000

[54] PLIERS WITH ERGONOMIC HANDLES

[75] Inventor: Hervé Gomas, Saint Fargeau Ponthierry, France

[73] Assignee: Facom, Morangis, France

[21] Appl. No.: 09/310,569

[22] Filed: May 12, 1999

[30] Foreign Application Priority Data

May 15, 1998 [FR] France ..... 98 06192

[51] Int. Cl.[7] ..... B25B 7/02

[52] U.S. Cl. ..... 81/427.5; 81/489; 16/110 R

[58] Field of Search ..... 81/427.5, 489; 16/110 R, 110

[56] References Cited

U.S. PATENT DOCUMENTS

| | | | |
|---|---|---|---|
| 4,829,858 | 5/1989 | Kern et al. | 81/427.5 X |
| 4,934,222 | 6/1990 | Rittmann et al. | 81/427.5 |
| 5,119,561 | 6/1992 | Olds . | |
| 5,279,034 | 1/1994 | Smith et al. . | |
| 5,463,814 | 11/1995 | Stowell et al. . | |

FOREIGN PATENT DOCUMENTS

| | | | |
|---|---|---|---|
| 0 228 659 | 7/1987 | European Pat. Off. . | |
| 2215294 | 8/1974 | France . | |
| 0538632 A1 | 4/1993 | Germany | 81/427.5 |
| 416 370 | 1/1967 | Switzerland . | |

OTHER PUBLICATIONS

American Machinist, Slip–Joint Pliers, p. 123, Dec. 1949.

*Primary Examiner*—David A. Scherbel
*Assistant Examiner*—Anthony Ojini
*Attorney, Agent, or Firm*—Wenderoth, Lind & Ponack, L.L.P.

[57] ABSTRACT

Pliers comprise two branches having an area forming a handle rigid with the branch and having, at least in a proximal part, a cross section whose profile is convex or essentially convex. The branches are pivoted to each other in a region including a coupler and extend beyond the coupler to define jaws. Each handle has, at least in its proximal part, a cross section which has, relative to its mid-line which is parallel to a median plane of the coupler, an asymmetric external profile with a shape which dips more sharply toward one side of the handle. In plan view, in the proximal part of each handle, the geometrical locus of the mid-points of segments perpendicular to the median plane forms a curve whose convex side is directed toward the aforementioned one side of the handle. Applications include gripping pliers such as flat-nose or round-nose pliers, universal pliers and adjustable pliers.

21 Claims, 3 Drawing Sheets

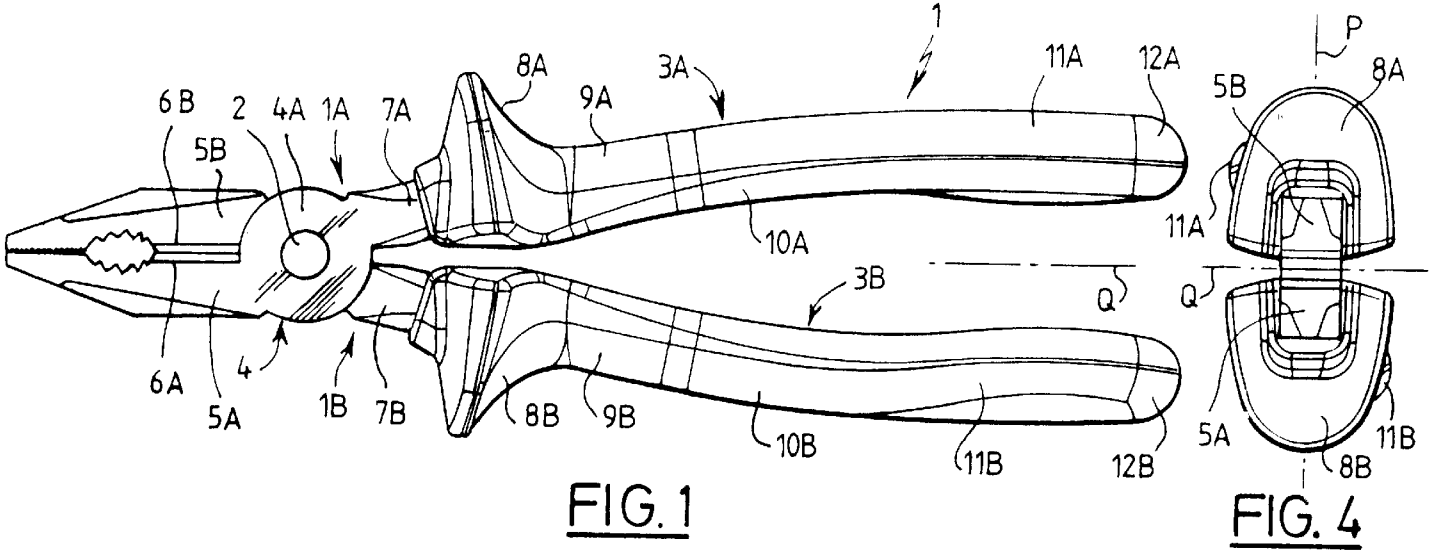
FIG. 1
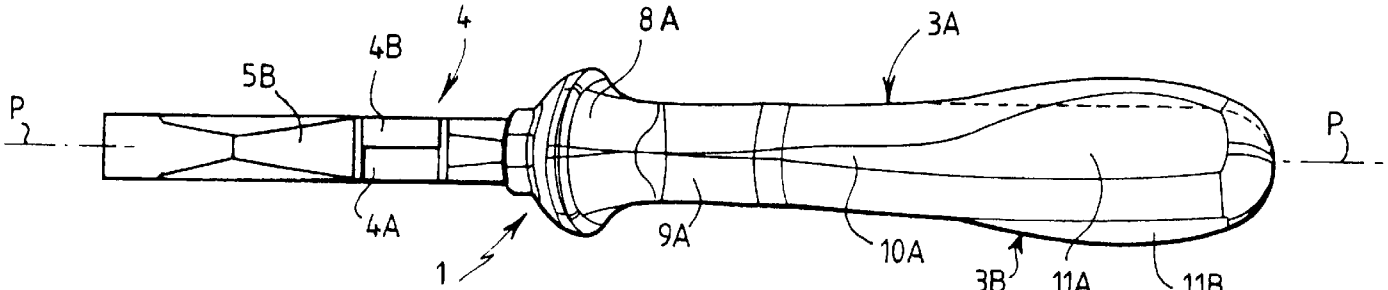
FIG. 2
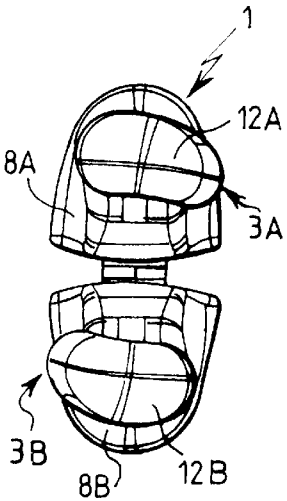
FIG. 3
FIG. 4

PLIERS WITH ERGONOMIC HANDLES

BACKGROUND OF THE INVENTION

1. Field of the Invention

The present invention concerns pliers comprising two branches having an area forming a handle rigid with the branch and having, at least in a proximal part, a cross section whose profile is convex or essentially convex. The branches are pivoted to each other in a coupler region and extend beyond the coupler region to define jaws.

2. Description of the Prior Art

The invention applies in particular to gripping pliers such as flat-nose or round-nose pliers, "universal" pliers and adjustable pliers.

The expression "essentially convex" profile means a closed profile with no strongly pronounced concavity, like that which results from bending a sheet of metal into a U-shape. Such concavities are encountered in the handles of secateurs and scissors but are incompatible with the imperatives for handles of pliers. Pliers must enable the user to apply very diverse forces repetitively: gripping, twisting, pulling, combined twisting and pulling, leverage perpendicular to the general direction of the handles, etc.

An aim of the invention is to improve the ergonomics of the handles of pliers in a manner that allows for the above imperatives.

SUMMARY OF THE INVENTION

To this end, the invention consists in pliers comprising two branches having an area forming a handle rigid with the branch and having, at least in a proximal part, a cross section whose profile is convex or essentially convex, the branches being pivoted to each other in a region including a coupler and extending beyond the coupler to define jaws, wherein each handle has, at least in the proximal part, a cross section which has, relative to its mid-line, which is parallel to a median plane of the coupler, an asymmetric external profile with a shape which dips more sharply toward one side of the handle and, in plan view, in the proximal part of each handle, the geometrical locus of the midpoints of segments perpendicular to the median plane forms a curve whose convex side is directed toward the aforementioned one side.

The invention also consists in a handle for pliers as defined hereinabove.

One embodiment of the invention will now be described with reference to the accompanying drawings.

BRIEF DESCRIPTION OF THE DRAWINGS

FIG. 1 is a side view of pliers in accordance with the invention.

FIG. 2 is a top view of the same pliers.

FIG. 3 is a rear view of the pliers.

FIG. 4 is a front view of the pliers.

DETAILED DESCRIPTION OF THE PREFERRED EMBODIMENTS

Figure 8:
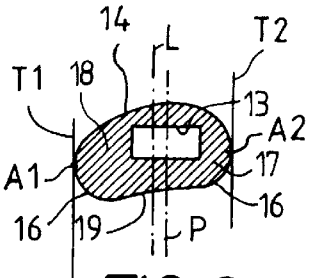
FIGS. 6 to 8 are views in section taken along the respective lines VI—VI to VIII—VIII in FIG. 5.

The "universal" pliers 1 shown in FIGS. 1 to 4 comprise two metal members 1A, 1B, a pivot pin in the form of a rivet 2 and two handles 3A, 3B made of one or more plastics and/or elastomer materials.

Each member 1A, 1B defines a planar half-coupler 4A, 4B from which a clamping jaw 5A, 5B extends forward. The member is extended toward the rear by a branch 7A, 7B of which only the front or distal end part can be seen in the drawings. The two half-couplers are pressed and held together by the rivet 2 to form the coupler 4 of the pliers. The two members 1A and 1B cross each other at the location of the coupler.

The median plane P of the coupler is the plane in which the two half-couplers 4A and 4B slide on each other.

Each handle 3A, 3B is molded in one or more operations onto the corresponding branch 7A, 7B or made separately and then threaded onto the branch and attached to it or made in one piece with the branch.

The shape of the "top" handle 3A (in the position shown in FIG. 1) is described in detail below. The shape of the other handle 3B is deduced from it by inverting it about the center line of the tool which, in the closed position of the pliers, is the line of intersection of the plane P and the median plane Q of the two handles passing through the axis of the rivet 2.

The handle 3A has, from the front toward the rear, a guard 8A, a distal part 9A, a transition part 10A and a proximal part 11A with a rounded end 12A. The parts 9A to 12A at least have no sharp edges. The lines shown in the various figures are imaginary lines intended to show clearly the shape of the handle.

Each handle has, in parts 9A to 12A, an essentially convex profile in cross section, in the sense indicated above and as described in more detail below.

However, at least a portion of the surface of each handle can include shallow recesses to improve the grip in the hand of the user, as is well known in this art.

The handle 3A has, from its front or distal end to a point in the part 11A spaced from the rear end of the handle, a blind passage 13 of rectangular section in which the branch 7A extends. The plane P is the plane of vertical symmetry of the passage 13. This passage has a substantially constant width and a height that reduces progressively toward the rear.

In the parts 9A and 10A, i.e. over substantially the front half of its length, the handle has an oval cross section substantially symmetrical about the mid-line L parallel to the plane P. The line L is the line halfway between the two tangents T1 and T2 to the section parallel to the plane P. In this example the line L is in the plane P.

Figure 6:
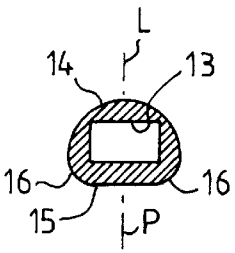
Figure 5:
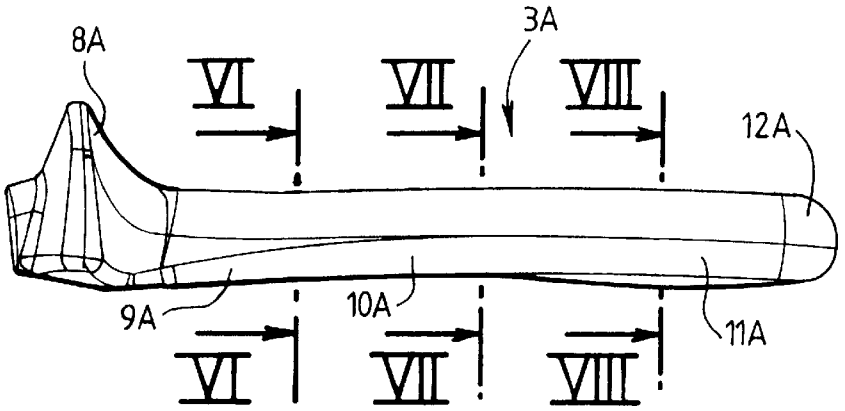
FIG. 5 is a side view of a handle of the pliers.

To be more precise, in the part 9A (FIG. 6) the section has an outside or top profile 14 which is virtually semicircular and an inside or bottom profile 15 which is substantially rectilinear and perpendicular to the plane P, with two broadly rounded junctions 16.

Figure 7:
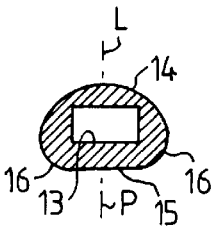

In the part 10A (FIG. 7) the profile is similar but more flattened, i.e. the top profile 14 is substantially half of an ellipse. Also, the profile is slightly wider than in the part 9A on each side of the line L.

The section of the handle changes considerably in the rear or proximal part 11A, where its profile assumes a kidney bean shape.

Accordingly, referring to FIG. 8, while the portion 17 to the right of the plane P retains substantially the same shape as the part 10A of the handle, the portion 18 to the left of that plane is significantly elongated horizontally.

Also, the portion 18 has a top profile that dips down more strongly.

Accordingly, the point of contact A1 of the portion 18 with the tangent T1 is nearer the plane Q than the point of contact A2 of the portion 17 with the tangent T2.

The line L is therefore shifted toward the left in FIG. 8, i.e. toward the palm of a right hand holding the pliers, and the top profile 14 is asymmetric about the line L.

Also, the bottom profile of the section is a slightly concave curve 19 that merges tangentially with the junctions 16.

Accordingly, in plan view (FIG. 9), the parts 9A and 10A of the handle 3A are delimited by substantially rectilinear top and bottom lines 21 and 22 parallel to the plane P. The line 22 continues, diverging slightly from the plane P, as far as the rounded end 12A, with which it merges tangentially.

In contrast, in the part 11A of the handle, the line 21 is diverted upward to form a convex curve 23 that merges tangentially with the rounded end 12A. The transition between the line 21 and the curve 23 is by way of a concave curve 24 with a large radius of curvature.

Figure 9:
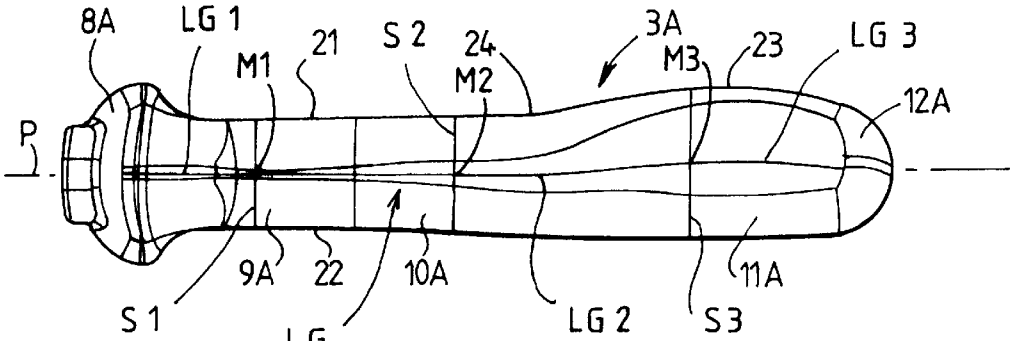
FIG. 9 is a top view of the same handle.

Considering, in FIG. 9, all segments of the handle perpendicular to the plane P, such as the segments S1, S2 and S3 in the respective parts 9A, 10A and 11A, the geometrical locus LG of the mid-points M1, M2 and M3 of the segments therefore forms a line LG1 which is close to the trace of the plane P in the parts 9A and 10A and which then curves upward (line LG2) and then downward (line LG3) in part 11A.

For the top handle of the pliers, the enlarged region 18 is obviously on the side of the palm of a right hand holding the tool. It follows from the foregoing description that, seen from above, the two handles are offset relative to each other in their parts 11A, 11B, as can be seen clearly in FIG. 2.

Considering the side view of the pliers as a whole (FIG. 1), the proximal parts 11A and 11B have external profiles that are substantially parallel to each other and to the plane Q.

The shape of the handles 3A, 3B described above has great advantages for a right-handed user:

- The area of contact of the top handle with the palm of the hand is very wide, which provides an improved grip and optimum adaptation to the movement of the hand closing onto the two handles.
- The flattened section of the handles enables effective closing of the four fingers, other than the thumb, in particular the ring finger and the little finger, onto the bottom handle to apply traction to the pliers. The flared concave shape of the contour 19 further facilitates this type of grip on the tool and also offers a large bearing surface area to the fingers for opening the pliers.
- Because of the substantially rectilinear outside shape of the parts 11A, 11B, when seen from the side, the pliers are easier to open and, in the open position, the gripping force does not tend to cause the hand to slide toward the front or toward the rear.
- All of the part of the handle in contact with the hand is free of sharp edges and so there is no risk of injury to the hand, regardless of the force or combination of forces exerted on the tool: gripping, twisting, pulling, combined twisting and pulling, leverage in the plane P, in the plane Q or in a plane between them.

The pliers described above and shown in the drawings have the aforementioned advantages for right-handed users without particular disadvantage or discomfort for left-handed users. In a variant, the deformations of the proximal part 11A of the handles could be more pronounced, to enhance the beneficial effects explained above, but it would then be necessary to produce for left-handed users a tool symmetrical about the plane P.

In another variant, the asymmetry of the handles may extend into the intermediate part 10A, 10B and even into the front part 9A, 9B, becoming progressively attenuated.

Figure 10:
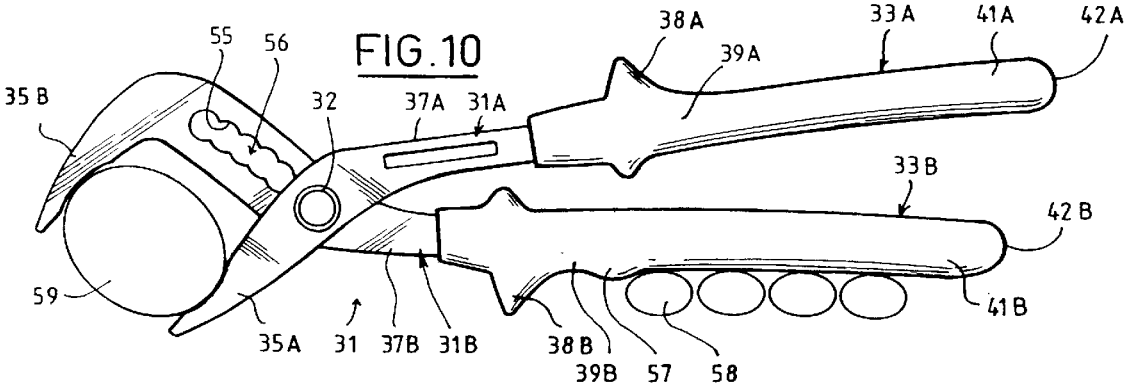
FIGS. 10 and 11 are diagrammatic side views of adjustable pliers in accordance with the invention in two different positions of use.
Figure 11:
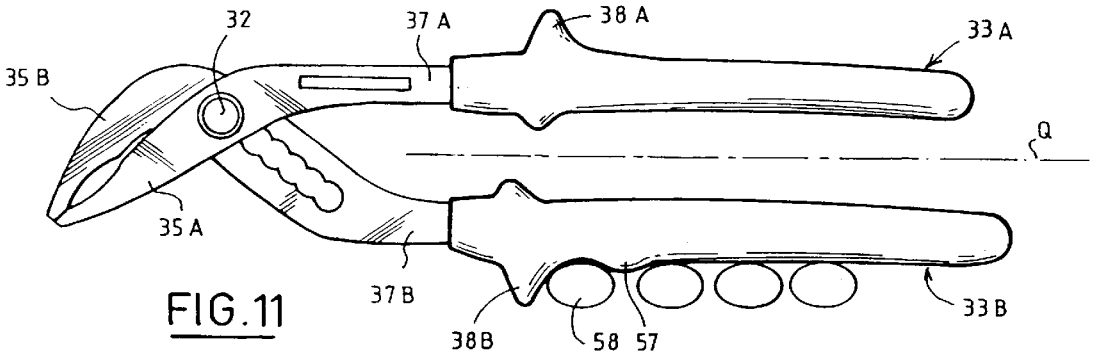

FIGS. 10 and 11 show adjustable pliers in accordance with the invention. Components common to the embodiment from FIGS. 1 to 9 are identified by the same reference numbers increased by 30 and are not described again.

The rivet 32 can be positioned in any of the detents 55 in an oblong slot 56 in the member 31B, as known per se. Consequently, when the pliers are closed (FIG. 11) the median plane Q of the two handles is parallel to but spaced from the axis of the rivet 32.

The bottom handle 33B has a guard 38B at its front end and a bead 57 to the rear of the guard projecting a smaller distance. The distance between the bead and the guard 38B is sufficient to accommodate an index finger (FIG. 11).

The user can therefore position the hand with the index finger 58 either just behind the bead 57 (FIG. 10) or between it and the guard 38B (FIG. 11).

In the former case, the gripping force is increased, which is advantageous for gripping and pushing a thick object 59. FIG. 10 shows that the guard 38A is then almost in line with the bead 57. Also, the hand is well immobilized toward the front when the branches of the pliers are at a large angle to each other.

In FIG. 11, a small part can easily be pushed and pulled. The guards 38A and 38B are substantially in line with each other.

Figure 12:
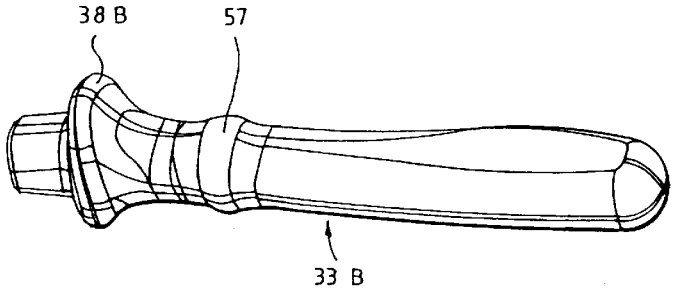
FIG. 12 is a perspective bottom view of the bottom handle of the pliers from FIGS. 10 and 11.

The bead 57 is extended laterally on both sides of the handle, for example by virtue of it having a substantially toroidal shape merging with the remainder of the handle through rounded portions (FIG. 12). This encourages correct positioning of the hand on the pliers, in particular when opening them.

The bead 57 can be provided on any type of pliers, with similar advantages. It improves the ergonomics of the tool with regard to the fingers at the front, in particular the index finger, and the asymmetric shape of the handles described above more particularly favors the fingers at the rear and the palm of the hand.

Figure 13:
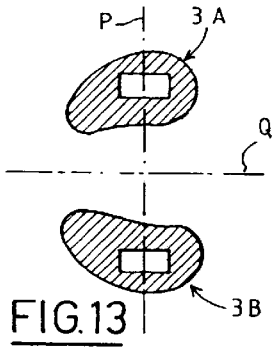
FIG. 13 is a front cross-sectional view of a variant of the above pliers.

In the FIG. 13 variant, relating to pliers with a fixed pivot axis, the cross sections of the two handles, in the distal part at least, are symmetrical relative to the median plane Q defined above. This enables left-handed persons to use the tool as effectively as right-handed persons merely by turning the pliers over about their center line.

There is claimed:

1. Pliers comprising two branches each having an area forming a handle rigid with the branch and having, at least in a proximal part, a cross section whose profile is essentially convex, said branches being pivoted to each other in a region forming a coupler of said pliers and extending beyond said coupler to define jaws, wherein each handle has, at least in said proximal part, a cross section which has, relative to a mid-line thereof which is parallel to a median plane of said coupler, an asymmetric external profile with a shape which dips more sharply toward one side of the handle and, in plan view, in said proximal part of each handle, a geometrical locus of the mid-points of segments perpendicular to said median plane forms a curve whose convex side is directed toward said one side.

2. The pliers claimed in claim 1 wherein, one of said handles is adapted to constitute a top handle and, on said one of said handles said one side is arranged to be directed toward a palm of a hand intended to hold said pliers.

3. The pliers claimed in claim 1 wherein, for each handle, said proximal part has a cross section that is wider than it is high.

4. The pliers claimed in claim 3 wherein said cross section is generally kidney bean shaped with a slightly concave inside profile.

5. The pliers claimed in claim 1 wherein, for each handle, said curve is extended toward the distal end of said handle by a second curve whose convex side is directed away from said one side.

6. The pliers claimed in claim 1 wherein said proximal part of each handle has, in side view, a substantially rectilinear outside profile, and the profiles of said handles are substantially parallel to each other.

7. The pliers claimed in claim 1 wherein at least said proximal parts of said handles have no sharp edges.

8. The pliers claimed in claim 7 wherein said handles have no sharp edges throughout their lengths.

9. The pliers claimed in claim 1 wherein, for each handle, said asymmetric profile extends as far as a distal end region of said handle.

10. The pliers claimed in claim 9 wherein, for each handle, said asymmetric profile is progressively attenuated toward said distal end region.

11. The pliers claimed in claim 1 wherein a distal end region of each handle has a cross section that is symmetrical relative to said mid-line.

12. The pliers claimed in claim 1 wherein, at least in said proximal parts, said two handles are, in transverse cross section, identical and symmetrical relative to a center line of said pliers.

13. The pliers claimed in claim 1 wherein, at least in said proximal parts, said two handles are, in transverse cross section, symmetrical relative to a median plane of said two handles which, in a closed position of said pliers, is parallel to a pivot axis of said two branches.

14. The pliers claimed in claim 1 wherein at least one if said handles has on its outside face a distal end guard and a single bead spaced from said guard by a distance which can accommodate an index finger.

15. The pliers claimed in claim 14 wherein said bead projects to a smaller height than said guard.

16. The pliers claimed in claim 14 wherein said bead extends laterally on both sides of said at least one of said handles.

17. The pliers claimed in claim 16 wherein said bead is generally toroidal in shape.

18. The pliers claimed in claim 1 constituting gripping pliers.

19. The pliers claimed in claim 1 constituting flat-nose pliers.

20. The pliers claimed in claim 1 constituting universal pliers.

21. The pliers claimed in claim 1 constituting adjustable pliers.

* * * * *